US005288077A

United States Patent [19]

Jones

[11] Patent Number: 5,288,077

[45] **Date of Patent: * Feb. 22, 1994**

[54] METHOD OF PROGRESSIVE JACKPOT TWENTY-ONE

[75] Inventor: Daniel A. Jones, Las Vegas, Nev.

[73] Assignee: D&D Gaming Patents, Inc., Fort Lauderdale, Fla.

[ * ] Notice: The portion of the term of this patent subsequent to Aug. 29, 2006 has been disclaimed.

[21] Appl. No.: 800,631

[22] Filed: Nov. 27, 1991

Related U.S. Application Data

[60] Continuation-in-part of Ser. No. 361,276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,863,553.

[51] Int. Cl.[5] ..... A63F 1/00

[52] U.S. Cl. ..... 273/292; 273/303

[58] Field of Search ..... 273/292, 303, 306, 309, 273/274

[56] References Cited

U.S. PATENT DOCUMENTS 4,861,081 8/1989 Jones et al. ..... 273/292

OTHER PUBLICATIONS

"Over/Under 13 Blackjack", Gaming Concepts, Inc., 1988.

*Primary Examiner*—Benjamin H. Layno

[57] ABSTRACT

The method of the present invention involves a Twenty-One game, in which, in addition to his normal wager, a player will have the option of making an additional wager that becomes part of, and makes the player eligible to win, the progressive jackpot. If the player's Twenty-One hand comprises a particular, predetermined arrangement of cards, the player will win all, or part of, the amount showing on the progressive jackpot. In a Twenty-One game using any number of decks of cards, the predetermined winning arrangements of cards preferred in the present invention are an Ace, Two, Three, Four and Five suited; a Two, Three, Four and Five suited; a Four, Five and Six suited; a Four, Five and Six unsuited and an Ace-Jack suited; and optionally additionally any Blackjack Suited and any Blackjack unsuited. In a Twenty-One game that utilizes a six deck shoe, an alternative predetermined winning arrangements of cards preferred in the present invention are Five Three's unsuited; Three Five's suited; a Four, Five and Six suited; a Four, Five and Six unsuited and an Ace-Jack suited.

21 Claims, No Drawings

METHOD OF PROGRESSIVE JACKPOT TWENTY-ONE

CROSS-REFERENCE TO RELATED APPLICATIONS

This application is a continuation-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,863,553.

BACKGROUND OF THE INVENTION

U.S. Pat. No. 4,861,041 describes a method and apparatus for progressive jackpot gaming in which a separate bet is utilized in a Twenty-One game. As described in that patent, a player may make an additional wager to be eligible to participate in a separate progressive jackpot. If during the play of the normal Twenty-One game the player achieves a predetermined arrangement of cards, the player wins all or part of the progressive jackpot amount.

In a preferred embodiment of the invention as described in U.S. Pat. No. 4,861,041, the predetermined arrangement of cards that resulted in winning hands and the respective payoff amounts from the progressive jackpot in a Twenty-One game were as follows:

| Winning Hand | Amount of Jackpot |
|---|---|
| Four 5's and an Ace | 100% |
| Ace, two, three, four, five and six | 4% |
| Six, seven and eight of same suit | 100 tokens |
| Three 7's | 50 tokens |

In practice, however, it became apparent that this predetermined arrangement of cards as the winning hands affected the play of the normal Twenty-One game. If a player were attempting to achieve one of the winning jackpot arrangements, the player may have to make card selection, or "hit," decisions during the play of the Twenty-One game that would be detrimental to his chances of winning the normal Twenty-One game. For example, if "Four Fives and an Ace" wins 100% of the progressive jackpot, a player holding two Fives and an Ace (a hand count of 21) would have to take a "hit" if the player were attempting to win the progressive jackpot amount. Since a 21 hand count is a very strong hand in Twenty-One, a player taking a hit on a hand of two Fives and an Ace would be risking a hand count that at worst would result in a tie, or "push," with the dealer.

It is an object of the present invention to provide predetermined arrangements of cards that constitute winning hands for the progressive jackpot component of a Twenty-One game where the predetermined arrangement of cards does not affect the play of the normal Twenty-One game.

It is a feature of the present invention that a predetermined arrangements of cards that constitute winning hands for the progressive jackpot component of a Twenty-One game (such as an Ace, Two, Three, Four and Five suited; a Two, Three, Four and Five suited; a Four, Five and Six suited; a Four, Five and Six unsuited; an Ace-Jack suited; any Blackjack Suited and any Blackjack, which are the preferred predetermined arrangements of cards when any number of decks are used) are selected so that the predetermined arrangement of cards does not affect the play of the normal Twenty-One game.

It is another feature of the present invention that a predetermined arrangements of cards that constitute winning hands for the progressive jackpot component of a Twenty-One game (such as Five Three's unsuited; Three Five's suited; a Four, Five and Six suited; a Four, Five and Six unsuited and an Ace-Jack suited, which are the preferred predetermined arrangements of cards when a six deck shoe is used) are selected so that the predetermined arrangement of cards does not affect the play of the normal Twenty-One game.

It is an advantage of the present invention that a player may attempt to achieve one of the predetermined arrangement of cards that will win all or part of the progressive jackpot component of the normal Twenty-One game without affecting the normal play of the Twenty-One game.

SUMMARY OF THE INVENTION

The method of the present invention involves a Twenty-One game, in which, in addition to his normal wager, a player will have the option of making an additional wager that becomes part of, and makes the player eligible to win, the, progressive jackpot. If the player's Twenty-One hand consists of a particular, predetermined arrangement of cards, the player will win all, or part of, the amount showing on the progressive jackpot. In a Twenty-One game using any number of decks of cards, the predetermined winning arrangements of cards preferred in the present invention are an Ace, Two, Three, Four and Five suited; a Two, Three, Four and Five suited; a Four, Five and Six suited; a Four, Five and Six unsuited and an Ace-Jack suited; and optionally additionally any Blackjack Suited and any Blackjack unsuited.

In a Twenty-One game that utilizes a six deck shoe, an alternative predetermined winning arrangements of cards preferred in the present invention are Five Three's unsuited; Three Five's suited; a Four, Five and Six suited; a Four, Five and Six unsuited and an Ace-Jack suited.

DETAILED DESCRIPTION OF THE PREFERRED EMBODIMENTS

The method of playing Twenty-One including a progressive jackpot component is described in detail in U.S. Pat. No. 4,861,041, which is incorporated herein by this reference thereto.

A conventional Twenty-One game is conducted on a gaming table. At the beginning of each hand, each player, in addition to making his usual wager for the play of the Twenty-One hand, may also make an additional wager to be eligible to participate in the progressive jackpot component of the game during that hand. Each wager made to be eligible for the progressive jackpot is added to the running total of the progressive jackpot amount.

The amount shown on the progressive jackpot meter will continue to increase for each gaming token wagered until a player achieves a winning hand. Predetermined winning hands earn a player all or part of the amount shown on the progressive jackpot meter.

In a normal Twenty-One game, the dealer deals cards to the players and the dealer according to the normal method of play. One or more standard decks of playing cards may be used.

As discussed above, the preselected hands that are eligible for winning a portion of the progressive jackpot amount should not interfere with the play of the underlying Twenty-One game. In order to try and achieve a winning jackpot hand, a player should not have to choose between keeping a probable winning Twenty-One hand or taking additional cards to try and achieve a winning progressive jackpot hand. The preselected winning hands for the progressive jackpot should be hands that would otherwise be probable losing hands in the underlying Twenty-One game. This gives the player a second chance to win during the Twenty-One game and encourages player participation in the jackpot feature of the invention.

In a preferred embodiment of the present invention when the Twenty-One game uses any number of decks of conventional playing cards (from one deck to as many decks as the house desires to include in the game) which are then shuffled together, the preselected winning hands in Twenty-One game are as follows:

TABLE 1

| Winning Hand | Amount of Jackpot |
|---|---|
| Ace, 2, 3, 4 and 5 suited | highest amount |
| 2, 3, 4 and 5 suited | second highest amount |
| 4, 5 and 6 suited | third highest amount |
| 4, 5 and 6 unsuited | fourth highest amount |
| Ace and Jack suited | fifth highest amount |

As used in this Table 1, "suited" means that each of the designated cards must be of the same card suit—Spades, Hearts, Diamonds or Clubs. "Unsuited" means that the suit of the card is not relevant to determining whether a winning hand has been achieved; cards of the same suit or cards of different suits are equally eligible in the winning hand.

The amounts paid for the various winning hands are not critical but should be determined based on conventional percentage controls methods so that the house maintains a reasonable profit from the operation of the game. In most regulated gaming jurisdictions, the house percentage should not exceed 15% on a theoretical hold basis.

As an additional modification to this preferred embodiment, two additional preselected winning hands and payoff amounts may be added to this schedule:

TABLE 2

| Additional Winning Hands | Amount of Jackpot |
|---|---|
| Any Blackjack suited | sixth highest amount |
| Any Blackjack unsuited | seventh highest amount |

As used in this Table 2, "Blackjack" means a two card hand having an Ace and a ten count card (King, Queen, Jack or 10).

In a more preferred embodiment of the present invention when the Twenty-One game uses any number of decks of conventional playing cards (from one deck to as many decks as the house desires to include in the game) which are then shuffled together, the preselected winning hands and payoff amounts in a Twenty-One game are as follows:

TABLE 3

| Winning Hand | Amount of Jackpot |
|---|---|
| Ace, 2, 3, 4 and 5 suited | 100% |
| 2, 3, 4 and 5 suited | 2500 tokens |
| 4, 5 and 6 suited | 100 tokens |
| 4, 5 and 6 unsuited | 100 tokens |
| Ace and Jack suited | 50 tokens |

As used in this Table 3, "suited" means that each of the designated cards must be of the same card suit—Spades, Hearts, Diamonds or Clubs. "Unsuited" means that the suit of the card is not relevant to determining whether a winning hand has been achieved; cards of the same suit or cards of different suits are equally eligible in the winning hand.

As an additional modification to this more preferred embodiment, two additional preselected winning hands and payoff amounts may be added to this schedule:

TABLE 4

| Additional Winning Hands | Amount of Jackpot |
|---|---|
| Any Blackjack suited | 10 tokens |
| Any Blackjack unsuited | 2 tokens |

As used in this Table 4, "Blackjack" means a two card hand having an Ace and a ten count card (King, Queen, Jack or 10).

It has become popular to use six decks of standard playing cards, all shuffled together, and held in a card holding device known as a "shoe." In a preferred embodiment of the present invention when the Twenty-One game uses six decks of conventional playing cards shuffled together and held in a shoe, the preselected winning hands in a Twenty-One game are as follows:

TABLE 5

| Winning Hand | Amount of Jackpot |
|---|---|
| Five 3's unsuited | highest amount |
| Three 5's suited | second highest amount |
| Four, Five and Six suited | third highest amount |
| Four, Five and Six unsuited | fourth highest amount |
| Ace and Jack suited | fifth highest amount |

As used in this Table 5, "suited" means that each of the designated cards must be of the same card suit—Spades, Hearts, Diamonds or Clubs. "Unsuited" means that the suit of the card is not relevant to determining whether a winning hand has been achieved; cards or the same suit or cards of different suits are equally eligible in the winning hand.

The amounts paid for the various winning hands are not critical but should be determined based on conventional percentage controls methods so that the house maintains a reasonable profit from the operation of the game. In most regulated gaming jurisdictions, the house percentage should not exceed 15% on a theoretical hold basis.

In a more preferred embodiment of the present invention when the Twenty-One game uses six decks of conventional playing cards shuffled together and held in a shoe, the preselected winning hands and payoff amounts in a Twenty-One game are as follows:

TABLE 6

| Winning Hand | Amount of Jackpot |
|---|---|
| Five 3's unsuited | 100% |
| Three 5's suited | 2500 tokens |
| Four, Five and Six suited | 100 tokens |

TABLE 6-continued

| Winning Hand | Amount of Jackpot |
|---|---|
| Four, Five and Six unsuited | 100 tokens |
| Ace and Jack suited | 50 tokens |

As used in this Table 6, "suited" means that each of the designated cards must be of the same card suit—Spades, Hearts, Diamonds or Clubs. "Unsuited" means that the suit of the card is not relevant to determining whether a winning hand has been achieved; cards or the same suit or cards of different suits are equally eligible in the winning hand.

In the event that two or more players achieve winning hand combinations during the same round of the Twenty-One game, the house can adopt appropriate tie-resolving rules. For example, players winning less than the full amount of the jackpot could be paid their winning amounts and a player winning the entire amount of the jackpot would then receive the remaining jackpot amount. Thus, the jackpot amount becomes the aggregate win amount that can be won during any one round of the Twenty-One game. This is similar to the conventional rules employed in a Keno game where the total amount available to win during any one Keno game is an aggregate amount with the smaller winnings being paid first and a player winning a large payout receives whatever is left of the aggregate amount.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of including a jackpot component in a Twenty-One game comprising the steps of:
   a) a player wagering a first gaming token to participate in the Twenty-One game,
   b) a player wagering a second gaming token to participate in the jackpot component,
   c) a dealer dealing a hand of playing cards to the player,
   d) if the player's hand consists of a predetermined arrangement of cards, the player wins a preselected amount of the jackpot,
   e) the predetermined arrangements of cards and the preselected winning amounts are:

| Winning Hand | Amount of Jackpot |
|---|---|
| Ace, 2, 3, 4 and 5 | highest amount |
| 2, 3, 4 and 5 suited | second highest amount |
| 4, 5 and 6 suited | third highest amount |
| 4, 5 and 6 unsuited | fourth highest amount |
| Ace and Jack suited | fifth highest amount. |

2. The method of claim 1 further including as additional predetermined arrangements of cards and preselected winning amounts:

| Additional Winning Hands | Amount of Jackpot |
|---|---|
| Any Blackjack suited | sixth highest amount |
| Any Blackjack unsuited | seventh highest amount. |

3. A method of including a jackpot component in a Twenty-One game comprising the steps of:
   a) a player wagering a first gaming token to participate in the Twenty-One game,
   b) a player wagering a second gaming token to participate in the jackpot component,
   c) a dealer dealing a hand of playing cards to the player,
   d) if the player's hand consists of a predetermined arrangement of cards, the player wins a preselected amount of the jackpot,
   e) the predetermined arrangements of cards and the preselected winning amounts are:

| Winning Hand | Amount of Jackpot |
|---|---|
| Ace, 2, 3, 4 and 5 | 100% |
| 2, 3, 4 and 5 suited | 2500 tokens |
| 4, 5 and 6 suited | 100 tokens |
| 4, 5 and 6 unsuited | 100 tokens |
| Ace and Jack suited | 50 tokens. |

4. A method of including a jackpot component in a Twenty-One game comprising the steps of:
   a) a player wagering a first gaming token to participate in the Twenty-One game,
   b) a player wagering a second gaming token to participate in the jackpot component,
   c) a dealer dealing a hand of playing cards to the player,
   d) if the player's hand consists of a predetermined arrangement of cards, the player wins a preselected amount of the jackpot,
   e) the predetermined arrangements of cards and the preselected winning amounts are:

| Winning Hand | Amount of Jackpot |
|---|---|
| Five 3's unsuited | highest amount |
| Three 5's suited | second highest amount |
| Four, Five and Six suited | third highest amount |
| Four, Five and Six unsuited | fourth highest amount |
| Ace and Jack suited | fifth highest amount. |

5. A method of including a jackpot component in a Twenty-One game comprising the steps of:
   a) a player wagering a first gaming token to participate in the Twenty-One game,
   b) a player wagering a second gaming token to participate in the jackpot component,
   c) a dealer dealing a hand of playing cards to the player,
   d) if the player's hand consists of a predetermined arrangement of cards, the player wins a preselected amount of the jackpot,
   e) the predetermined arrangement of cards and the preselected winning amounts are:

| Winning Hand | Amount of Jackpot |
|---|---|
| Five 3's unsuited | 100% |
| Three 5's suited | 2500 tokens |
| Four, Five and Six suited | 100 tokens |
| Four, Five and Six unsuited | 100 tokens |
| Ace and Jack suited | 50 tokens. |

6. A method of including a jackpot component in a live casino table game comprising the steps of:

a) a player wagering at least one first gaming token to participate in the live casino table game;

b) a player wagering at least one second gaming token to participate in the jackpot component;

c) a dealer dealing a hand of playing cards to the player; and d) if the player's hand comprises a predetermined arrangement of cards, the player wins a predetermined fixed amount.

7. The method of claim 6 wherein the predetermined arrangement of cards comprises three 7's.

8. The method of claim 6 wherein the predetermined arrangement of cards comprises three 7's of the same suit.

9. The method of claim 6 wherein the predetermined arrangement of cards includes at least one 7.

10. The method of claim 6 wherein the live casino table game comprises Twenty-One.

11. The method of claim 10 wherein the predetermined arrangement of cards comprises three 7's.

12. The method of claim 10 wherein the predetermined arrangement of cards comprises three 7's of the same suit.

13. The method of claim 10 wherein the predetermined arrangement of cards includes at least one 7.

14. A method of including a jackpot component in a live casino table game comprising the steps of:

a) a player wagering at least one first gaming token to participate in the live casino table game;

b) a player wagering at least one second gaming token to participate in the jackpot component;

c) a dealer dealing a hand of playing cards to the player; and d) if the player's hand consists of a predetermined arrangement of cards, the player wins a predetermined fixed amount.

15. The method of claim 14 wherein the predetermined arrangement of cards consists of three 7's.

16. The method of claim 14 wherein the predetermined arrangement of cards consists of three 7's of the same suit.

17. The method of claim 14 wherein the predetermined arrangement of cards includes at least one 7.

18. The method of claim 14 wherein the live casino table game comprises Twenty-One.

19. The method of claim 18 wherein the predetermined arrangement of cards consists of three 7's.

20. The method of claim 18 wherein the predetermined arrangement of cards consists of three 7's of the same suit.

21. The method of claim 18 wherein the predetermined arrangement of cards includes at least one 7.

* * * * *

US005288077C1

(12) REEXAMINATION CERTIFICATE (4395th)

United States Patent

Jones

(10) Number: US 5,288,077 C1

(45) **Certificate Issued: *Jul. 10, 2001**

(54) METHOD OF PROGRESSIVE JACKPOT TWENTY-ONE

(75) Inventor: Daniel A. Jones, Las Vegas, NV (US)

(73) Assignee: D&D Gaming Patents, Inc., Fort Launderdale, FL (US)

Reexamination Request:
No. 90/003,842, May 25, 1995

Reexamination Certificate for:

| | |
|---|---|
| Patent No.: | **5,288,077** |
| Issued: | **Feb. 22, 1994** |
| Appl. No.: | **07/800,631** |
| Filed: | **Nov. 27, 1991** |

( * ) Notice: This patent is subject to a terminal disclaimer.

Related U.S. Application Data

(60) Continuation-in-part of application No. 07/361,276, filed on Jun. 5, 1989, now Pat. No. 5,078,405, which is a division of application No. 07/214,934, filed on Jul. 5, 1988, now Pat. No. 4,861,041, which is a continuation-in-part of application No. 07/182,374, filed on Apr. 18, 1988, now Pat. No. 4,863,553.

(51) Int. Cl.[7] ..... A63F 1/00

(52) U.S. Cl. ..... 273/292; 273/303

(58) Field of Search ..... 273/92, 292

(56) References Cited

U.S. PATENT DOCUMENTS

| | | |
|---|---|---|
| D. 105,610 | 8/1937 | Posey . |
| D. 118,451 | 1/1940 | Radford . |
| D. 183,007 | 6/1958 | Lord . |
| D. 213,891 | 4/1969 | Schultz . |
| D. 220,635 | 5/1971 | Boyer et al. . |
| D. 245,717 | 9/1977 | Jessie . |
| D. 263,975 | 4/1982 | Quiroga et al. . |
| D. 311,474 | 10/1990 | Hoffman . |
| 1,238,736 | 9/1917 | Barrett . |
| 1,527,929 | 2/1925 | Simons . |
| 1,763,476 | 6/1930 | Morris . |
| 1,970,876 | 8/1934 | Anderson . |
| 2,008,829 | 10/1935 | Israel . |
| 2,199,745 | 5/1940 | Harris . |
| 3,011,789 | 12/1961 | Eliassen et al. . |
| 3,269,503 | 8/1966 | Foster . |
| 3,556,531 | 1/1971 | Elder . |
| 3,663,021 | 5/1972 | Whippo . |
| 3,667,757 | 6/1972 | Holmberg . |
| 3,689,071 | 9/1972 | Kucera . |
| 3,796,433 | 3/1974 | Fraley et al. . |
| 3,825,255 | 7/1974 | Kennard et al. . |

(List continued on next page.)

FOREIGN PATENT DOCUMENTS

| | | |
|---|---|---|
| 621599 | 4/1989 | (AU) . |
| 628044 | 4/1989 | (AU) . |
| 96049 | 4/1989 | (AT) . |
| 1334983 | 3/1995 | (CA) . |
| 1335381 | 4/1995 | (CA) . |
| 2830216 | 1/1980 | (DE) . |
| 3003376 | 8/1981 | (DE) . |
| 68909992 | 4/1989 | (DE) . |
| 4792 | 6/1991 | (DO) . |
| 4793 | 6/1991 | (DO) . |
| 4825 | 3/1993 | (DO) . |
| 4999 | 8/1993 | (DO) . |
| 0338644 | 4/1989 | (EP) . |
| 2097570 | 4/1982 | (GB) . |
| 2169736 | 7/1986 | (GB) . |
| 2184029 | 6/1987 | (GB) . |
| 0338644 | 4/1989 | (IT) . |
| 135187 | 6/1988 | (JP) . |
| 9220417 | 11/1992 | (WO) . |
| 9310869 | 6/1993 | (WO) . |
| 9415684 | 7/1994 | (WO) . |
| 9521665 | 8/1995 | (WO) . |

OTHER PUBLICATIONS

Tripoley, "How to Play," Cadeco, Inc., 1968.*

Sklansky "Casino Poker" rule card, TX899,489, copyrighted Apr. 4, 1982.

Bob Stupak's Vegas World "Casino Poker Rules".

Winning Gamer, Issue #5, Feb. 1985, Pi Yee Press, LaJolla, CA.

Winning Gamer, Issue #6, Mar. 1985, Pi Yee Press, LaJolla, CA.

Winning Gamer, Issue #15, Dec. 1985, Pi Yee Press, LaJolla, CA.

Winning Gamer, Issue #19, Apr. 1986, Pi Yee Press, LaJolla, CA.

Winning Gamer, Issue #20, May 1986, Pi Yee Press, LaJolla, CA.

Winning Gamer, Issue #21, Jun. 1986, Pi Yee Press, LaJolla, CA.

Scarne, Scarne's Encyclopedia of Games, Harper & Row, N.Y., Copyright 1973, p. 381, 383 and title pages.

Scarne, Scarne's Encyclopedia of Games, Harper & Row, N.Y. Copyright 1973, p. 33–41 and title pages.

(List continued on next page.)

*Primary Examiner*—Mark A. Sager

(57) ABSTRACT

The method of the present invention involves a Twenty-One game, in which, in addition to his normal wager, a player will have the option of making an additional wager that becomes part of, and makes the player eligible to win, the progressive jackpot. If the player's Twenty-One hand comprises a particular, predetermined arrangement of cards, the player will win all, or part of, the amount showing on the progressive jackpot. In a Twenty-One game using any number of decks of cards, the predetermined winning arrangements of cards preferred in the present invention are an Ace, Two, Three, Four and Five suited; a Two, Three, Four and Five suited; a Four, Five and Six suited; a Four, Five and Six unsuited and an Ace-Jack suited; and optionally additionally any Blackjack Suited and any Blackjack unsuited. In a Twenty-One game that utilizes a six deck shoe, an alternative predetermined winning arrangements of cards preferred in the present invention are Five Three's unsuited; Three Five's suited; a Four, Five and Six suited; a Four, Five and Six unsuited and an Ace-Jack suited.

U.S. PATENT DOCUMENTS

| | | |
|---|---|---|
| 3,874,671 | 4/1975 | Smith . |
| 3,876,208 | 4/1975 | Wachtler et al. . |
| 4,063,680 | 12/1977 | Leo . |
| 4,099,722 | 7/1978 | Rodesch et al. . |
| 4,232,866 | 11/1980 | Pennachio . |
| 4,302,012 | 11/1981 | Di Giovanni et al. . |
| 4,305,586 | 12/1981 | Richards . |
| 4,364,567 | 12/1982 | Gootl . |
| 4,397,469 | 8/1983 | Carter, III . |
| 4,518,001 | 5/1985 | Branham . |
| 4,531,187 | 7/1985 | Uhland . |
| 4,575,085 | 3/1986 | Ollington . |
| 4,614,342 | 9/1986 | Takashima . |
| 4,624,459 | 11/1986 | Kaufman . |
| 4,648,604 | 3/1987 | Horan . |
| 4,651,997 | 3/1987 | Wood . |
| 4,700,948 | 10/1987 | Okada . |
| 4,721,307 | 1/1988 | Okada . |
| 4,743,022 | 5/1988 | Wood . |
| 4,756,531 | 7/1988 | DiRe et al. . |
| 4,759,549 | 7/1988 | Beckwith . |
| 4,760,527 | 7/1988 | Sidley . |
| 4,813,675 | 3/1989 | Greenwood . |
| 4,836,546 | 6/1989 | DiRe et al. . |
| 4,836,553 | 6/1989 | Suttle et al. . |
| 4,837,728 | 6/1989 | Barrie et al. . |
| 4,861,041 | 8/1989 | Jones et al. . |
| 4,948,134 | 8/1990 | Suttle et al. . |
| 4,964,638 | 10/1990 | Ishida . |
| 5,007,519 | 4/1991 | Mercurio . |
| 5,022,653 | 6/1991 | Suttle et al. . |
| 5,042,818 | 8/1991 | Weingardt . |
| 5,078,405 | 1/1992 | Jones et al. . |
| 5,098,107 | 3/1992 | Boylan et al. . |
| 5,112,060 | 5/1992 | Jones . |
| 5,249,800 | 10/1993 | Hilgendorft et al. . |
| 5,257,810 | 11/1993 | Schorr et al. . |
| 5,275,400 | 1/1994 | Weingardt et al. . |
| 5,277,424 | 1/1994 | Wilms . |
| 5,288,077 | 2/1994 | Jones . |
| 5,288,081 | 2/1994 | Breeding . |
| 5,364,104 | 11/1994 | Jones et al. . |
| 5,364,105 | 11/1994 | Jones . |
| 5,374,067 | 12/1994 | Jones . |
| 5,377,973 | 1/1995 | Jones . |
| 5,377,994 | 1/1995 | Jones . |
| 5,380,012 | 1/1995 | Jones . |
| 5,382,025 | 1/1995 | Sklansky et al. . |
| 5,393,067 | 2/1995 | Paulsen et al. . |

OTHER PUBLICATIONS

Scarne, Scarne's New Complete Guide to Gambling, Simon & Schuster, N.Y., Copyright 1961, p. 450–445 and title pages.

Scarne, Scarne's Encyclopedia of Card Games, Harper & Row, N.Y., Copyright 1983, p. 299–304, 383, and title pages.

W.B. Gibson, Hoyle's Modern Encyclopedia of Card Games, p. 218–19, 369–70 (1974).

Casino Player, vol. IV, No. 12, Aug. 1993, "My Biggest Slot Jackpot", Stanford Wong.

Gaming Concepts, Inc. "Over/Under 13 Blackjack" brochure, 1988.

Casino Journal, vol. 8, No. 12, Dec. 1992, "Working Within The Systems: IGT's linked progressive programs take leap to the tables", p. 10–15, 40, 41.

Casino Gaming, Sep. 1988, "Aruba Deals A New Game: Caribbean Stud Poker", p. 12–13.

Casino Journal, vol. 8, No. 6, Jun. 1993, "So You Wanna Be A Gambler", p. 1, 5.

Information Disclosure Statement, Apr. 7, 1988, Describing "Sklansky's Casino Poker" and Video Poker.

Coin Hopper Model CH–500 and Model No. DH–750/U1 literature Asahi Seiko.

Review Journal, "Gamblers Take Chance at Million Dollar Payoff", by C. J. Boyer.

Winning Gamer, Issue #17, Feb. 1986, Pi Yee Press, LaJolla, CA.

Scarne, Scarne's Encyclopedia of Games, "Hold 'Em", Harper & Row Publishers, Copyright 1973, p. 14–18, 26.

Abercrinbue & Fitch, Play Hours, 1960, p. 11, Blackjack Towel.

Scarne, Scarne's Encyclopedia of Card Games, copyright date unknown, p. 288.

Jim Kilby's Declaration under 37 C.F.R. § 1.132.

TXU 184,603, Mar. 30, 1985.

TX 2,568,066, Mar. 6, 1989.

Scarne, Scarne's Guide to Modern Poker, copyright unknown, p. 40, 60–61 do date available.

Request for Reexamination, U.S. Pat. No. 4,861,041; issued Aug. 29, 1989; Date of Service: Jun. 20, 1995.

Request for Reexamination, U.S. Pat. No. 5,288,077, issued Feb. 22, 1994; Date of Service May 26, 1995.

Request for Reexamination, U.S. Pat. No. 5,364,105, issued Nov. 15, 1994; Date of Service May 26, 1995.

Asahi Seiko Catalog No. AV89C, Aug. 20, 1989, p. 44, 51 and Photograph "A".

Scarne, Scarne's Encyclopedia of Games, Copyright 1973, p. 11, 31, 440–445.

Scarne, Scarne's Encyclopedia of Games, Harper & Row, Copyright 1973, title pages and p. 33–37.

Over/Under 13™ Blackjack Brochure no date available.

Registration Deposit for Copyright—Over/under 13™ Blackjack.

"Big Field" Blackjack Rules/Declaration of date of publication.

Scarne Encyclopedia of Card Games by John Scarne: pp. 288, 299–304 and 383 ("Pontoon") ("Scarvey Baccarat") ("Tripoley").

* cited by examiner

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–21 is confirmed.

* * * * *